United States Patent [19]

Portuese

[11] Patent Number: 4,878,277

[45] Date of Patent: Nov. 7, 1989

[54] CHILD PROOF SEAT BELT RESTRAINT

[76] Inventor: Peter Portuese, 39 Huron St., Port Jefferson Station, N.Y. 11776

[21] Appl. No.: 291,172

[22] Filed: Dec. 28, 1988

[51] Int. Cl.[4] ..... A44B 11/26

[52] U.S. Cl. ..... 24/633; 24/573

[58] Field of Search ..... 24/633, 573, 574, 632–657; 297/468; 292/DIG. 2, DIG. 11, DIG. 65

[56] References Cited

U.S. PATENT DOCUMENTS

| | | | |
|---|---|---|---|
| 3,109,900 | 11/1963 | Van Hook | 292/DIG. 65 |
| 3,484,908 | 12/1969 | Lamb | 24/323 X |
| 4,624,033 | 11/1986 | Orton . | |
| 4,638,533 | 1/1987 | Gloomis et al. | 24/633 |
| 4,674,303 | 6/1987 | Salcone . | |
| 4,675,954 | 6/1987 | Gullickson . | |
| 4,731,912 | 3/1988 | Bariskie et al. | 24/574 X |

FOREIGN PATENT DOCUMENTS

| | | | |
|---|---|---|---|
| 3445822 | 9/1986 | Fed. Rep. of Germany . | |
| 3501747 | 9/1986 | Fed. Rep. of Germany . | |
| WO84/01275 | 4/1984 | PCT Int'l Appl. | 24/633 |
| 2048651 | 12/1980 | United Kingdom . | |

*Primary Examiner*—James R. Brittain

*Attorney, Agent, or Firm*—Terry M. Gernstein

[57] ABSTRACT

A child proof cover for covering and encasing a seat belt buckle assembly includes a channel which provides access to the release control of the seat belt buckle assembly. The channel is sized and configured so that a child cannot reach the release control but an adult can reach the control to operate such control in the manner in which that control was designed to operate. The cover can include a device for preventing separation of the seat belt buckle elements in addition to the cover. The cover can include tear-off portions for adjusting the length of the finger access channel.

7 Claims, 4 Drawing Sheets

CHILD PROOF SEAT BELT RESTRAINT

TECHNICAL FIELD OF THE INVENTION

The present invention broadly relates to the general field of seat belts used in the passenger vehicles, and particularly relates to the field of such seat belts as used for children. Specifically, the present invention relates to a means for preventing a child from operating a release control associated with a seat belt assembly.

BACKGROUND OF THE INVENTION

Seat belts have been shown to have great utility in preventing injury to passengers of motor vehicles. Specifically, such seat belts have been proven to accomplish such object by preventing, inter alia, a passenger from moving forward far enough to have his head impact the dashboard or the windshield in an accident.

As is also well documented, children, especially very small children, are more susceptible to such head injury causing impact than adults because, in a collision, a child can be launched from a seat in a missile-like manner toward the windshield without impediment; whereas, an adult at least may have his legs contact the dashboard thereby slowing his velocity toward the impact point.

For this reason, it is extremely important for a child to be securely belted in place at all times when a motor vehicle is in operation. Accordingly, there have been several designs proposed especially for children.

However, a seat belt is of little or no use if the child unbuckles it. Therefore, there have been designs for "child proofing" the seat belt release control. Such child proofing means should balance a need to prevent the child from operating the release control, with the need for the belt release to be operable by an adult in a manner which permits the belt to be quickly released in the event of an accident.

Heretofore known child proofing means have included providing a release control actuating means that is too stiff for a child to operate, by including a key lock mechanism, or by being too complicated for a child to operate.

These known child proofing means have not been entirely successful because, while they may accomplish the object of preventing a child from operating the belt release control, they do so in a manner that interferes with the designed operation of the belt control itself and thus do not perform the afore-discussed balancing in an effective manner.

That is, by including a key lock, for example, the easy access to the release control itself is impaired or by including means that is too stiff for a child to operate, the designed operation of the release control is inhibited.

For this reason, while known child proofing means have been proposed, automobile manufacturers and sellers have been reluctant to include them for fear that the interference with the design considerations of the seat belt release control will be more dangerous than is acceptable.

A still further reason for the limited acceptance of the known child proofing means is that they may be difficult or expensive to manufacture thereby being too expensive to sell to a car buyer.

OBJECTS OF THE INVENTION

It is a main object of the present invention to provide a means for child proofing the release control of a seat belt assembly which operates in a manner that is effective to prevent a child from actuating the release control yet which does not interfere with the designed operation of that seat belt release control.

It is another object of the present invention to provide a means for child proofing the release control of a seat belt assembly which operates to prevent access to the release control by a child yet which provides easy operation of such release control by an adult.

It is another object of the present invention to provide a means for child proofing the release control of a seat belt assembly that is efficient to manufacture in a cost-effective manner.

SUMMARY OF THE INVENTION

These, and other, objects are accomplished by encasing the seat belt assembly in a housing includes a finger access channel which connects the release control with the outside of the housing, with the finger access channel being sized to be too long for a child to reach the control but which is not too long for an adult to reach the control via the channel.

In this manner, the release control is operated in its normal manner, but is only operable by an adult.

DETAILED DESCRIPTION OF THE PREFERRED EMBODIMENT

Figure 1:
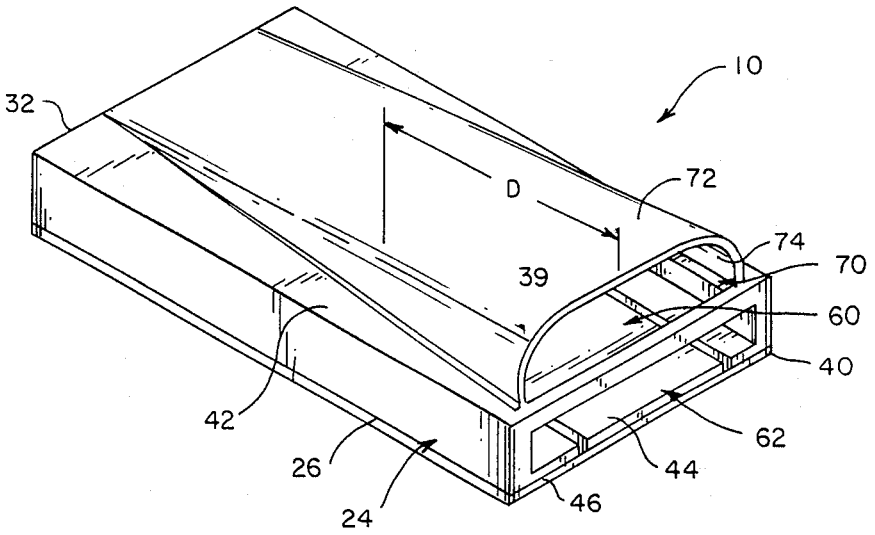
FIG. 1 is a perspective view of the child proofing cover embodying the present invention.
Figure 2:
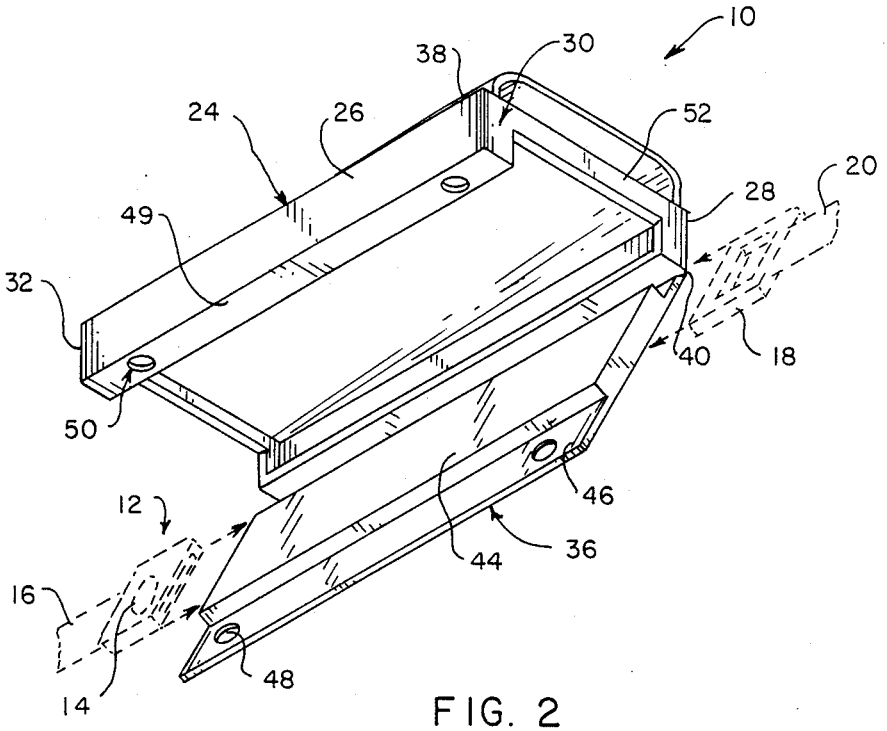
FIG. 2 is a perspective view of the child proofing cover in an open configuration.

Shown in FIGS. 1 and 2 is a child-proof cover 10 for preventing a child from releasing a seat belt buckle assembly which includes a first buckle element 12 having a release control 14 and which is operatively attached to a first seat belt 16 and which also includes a second buckle element 18 operatively attached to a second seat belt 20. The seat belt buckle assembly operates in the normal and designed manner, and thus will not be discussed in detail except to point out that the release control 14 releases the seat belts 16 and 20 from connection together when operated so that these belts can be pulled apart.

The cover 10 is designed so that an adult can operate the control 14 in the normal manner, yet will prevent a child from so operating that control. To accomplish such objective, the cover 10 includes an elongated housing 24 having sides 26 and 28 which connect ends 30 and 32 together. The housing 24 further includes a bottom 36 connected to a top 38 by a living hinge 40 which permits the top and the bottom to swing away and towards each other as indicated by comparing FIGS. 1 and 2 with each other.

The top 38 includes a top surface 42 and the bottom includes a pallet 44 located between wings 46 which include fastener receiving holes 48 therein. The cover sides include fastener receiving holes 48 therein. The cover sides include fastener receiving shoulders 49 having holes 50 which co-operate with the fastener receiving holes 48 to couple the housing top to the housing bottom when fasteners, such as screws or the like (not shown), are operatively engaged in the fastener receiving holes 48 and 50.

Each end 30 and 32 of the cover has a bulkhead-like element, such as element 52 on end 30, thereon. As will be apparent from the ensuing discussion, these bulkhead-like elements serve to guide the seat belt buckle assembly into position in the cover.

When the top and the bottom are coupled together as indicated in FIG. 1, there is defined a seat belt buckle assembly accommodating chamber 60 in the cover. As is also shown in FIG. 1, when such top and bottom are coupled together, the bulkhead-like elements engage the bottom to form a first slot which accommodate the first seat belt 16 therethrough and a second slot 62 which accommodates the second seat belt 20 therethrough when the buckle assembly is located and accommodated in the chamber 60.

As is best shown in FIG. 1, the cover 10 includes a finger access channel 70 which couples the chamber 60 to the outside of the cover in a manner such that a child cannot place his fingers into the chamber far enough to operate the release 14 but an adult's fingers are long enough to reach that release 14 from outside of the cover.

The channel is formed by a channel-defining hood element 72 that is located on top of the top element and is elongate to extend from adjacent to end 30 far enough to connect the release 14 to the end 30 via the channel formed by the hood element 72 and the housing. In the preferred embodiment, the hood extends to adjacent end 32.

The hood is longitudinally curved and sloped and is lengthwise receding from the largest portion thereof adjacent to the end 30 to the smallest portion thereof at the other end of the channel.

Thus, the hood forms an entrenceway 74 adjacent to the end 39 thereof, and extends over the release 14. In the preferred embodiment, the end 39 is adjacent to the end 30 of the cover. The hood has a length as measured from end 39 along the longitudinal axis of the hood that is selected so that the distance, indicated in FIG. 1 by arrow D, from the entrenceway to a location adjacent to the release 14 of the buckle assembly located in the chamber is greater than the length of a child's fingers but which is less than the length of an adult's fingers.

A preferred dimension for distance D is about two and one-half inches. Any child who has fingers long enough to reach such a distance should be old enough to realize not to operate the release 14.

In this manner, a child will not be able to reach into the channel far enough to operate the release, but an adult will be able to reach into the channel far enough to operate the release quickly and in the manner for which it was designed. The channel entrenceway is also wide enough to accommodate an adult's fingers in a free manner.

It is noted that the slots, such as slot 62, are wide enough to permit the buckle elements 12 and 18 to move into the chamber 60 so that, once released, the seat belts can be easily moved out of the way to permit the child to move from the car in the normal manner.

The cover 10 can be used to ensure that the seat belts will remain coupled together even if a child inadvertently does release the control 14. Such embodiments are shown in FIGS. 3–6.

Figure 3:
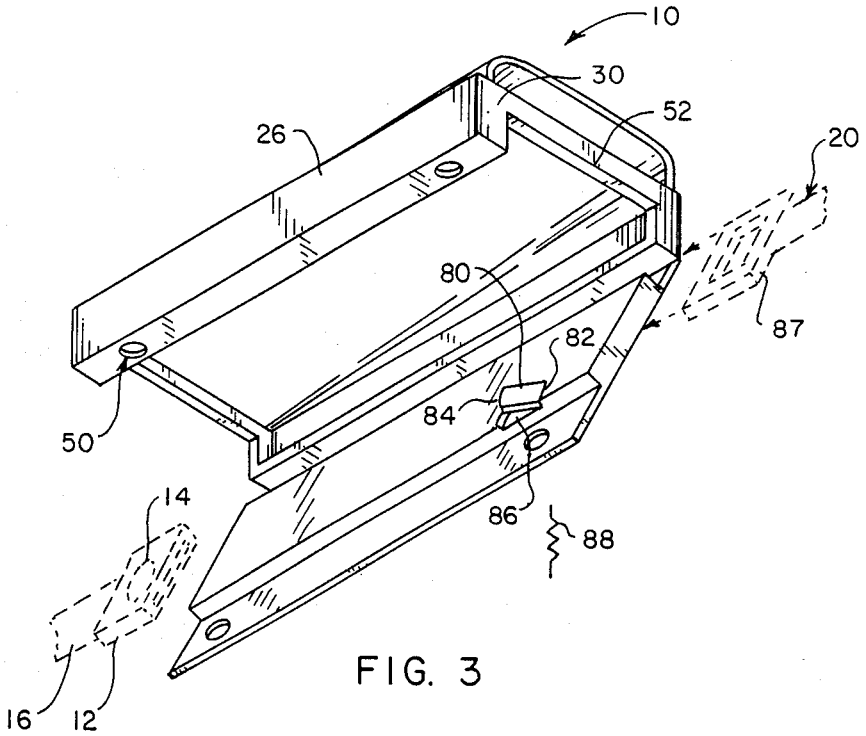
FIG. 3 is a perspective view of a second embodiment of a child proofing cover of the present invention and which includes a buckle assembly separation preventing means.

In these additional embodiments, a buckle separation preventing means is included. This means is shown in FIG. 3 as including a tab element 80 pivotally mounted on the pallet 44 by a living hinge 82 at one end and having a free end 84. The tab element 80 is adapted to rest in a recess 86 defined in the pallet 44 to be flush with the upper surface of the pallet 44 when it is received in that recess so that the buckles will remove freely over and/or by that tab element. The tab element is located beside the path used by the buckle element 18 in moving into and out of the chamber, but is located so that free end 84 will abut the rear end 87 of the element 18 when that element is coupled to the element 14 in the chamber. The tab is removed from the recess to the element abutting position by hooking a fingernail beneath an arch-shaped portion of the free end 84 and pulling the tab up out of the recess. The tab is located so that an adult can easily gain access thereto after locking the buckle elements together. The tab can be pushed down into the recess by the adult placing his finger through the entrenceway of the hood and forcing the tab down into the recess, and then operating the release control.

The use of two separate operations to release the buckle will ensure that even if a child gets his hands or fingers in the proper position in the chamber to operate the release, he will not be likely to release the buckles. Still further, such tab will act as a safety mechanism to hold the buckles in coupled configuration even if the buckle release is operated by preventing one element from withdrawing from the other element.

The separation prevention means can further include a spring 88 biasing the tab element upwardly if so desired. The spring 88 is shown beside the cover in FIG. 3 for the sake of clarity, but will be coupled to the tab element and to the pallet adjacent to the recess 86. The spring element 88 can act to guide the tab in its upward and downward movements. The adult will simply be required to hold the tab down to withdraw the buckles in such a case.

Figure 5:
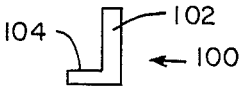
FIG. 5 is a view taken along line 5—5 of FIG. 4 and shows a track for guiding movement of the button means.
Figure 4:
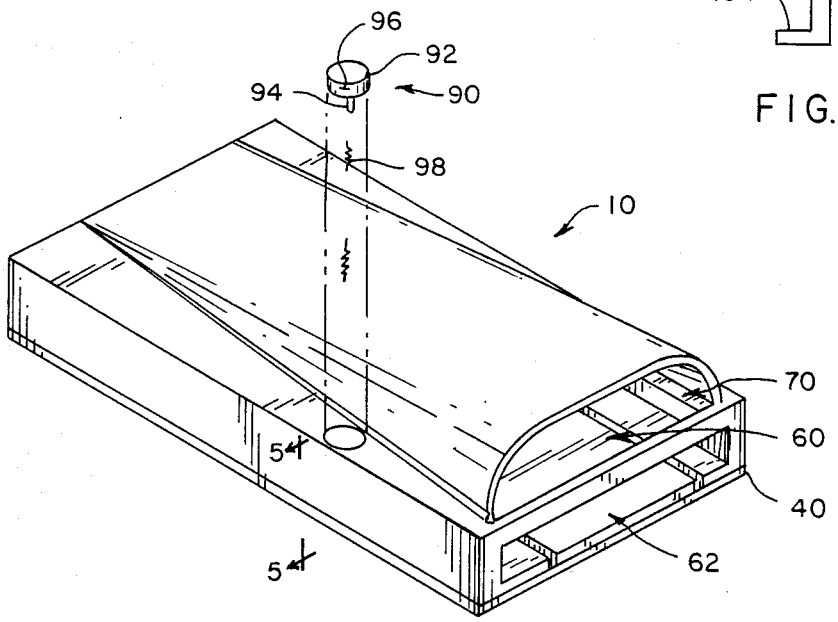
FIG. 4 is a perspective view of a third embodiment of a child proofing cover of the present invention and which includes button means for moving the buckle assembly separation preventing means.
Figure 6:
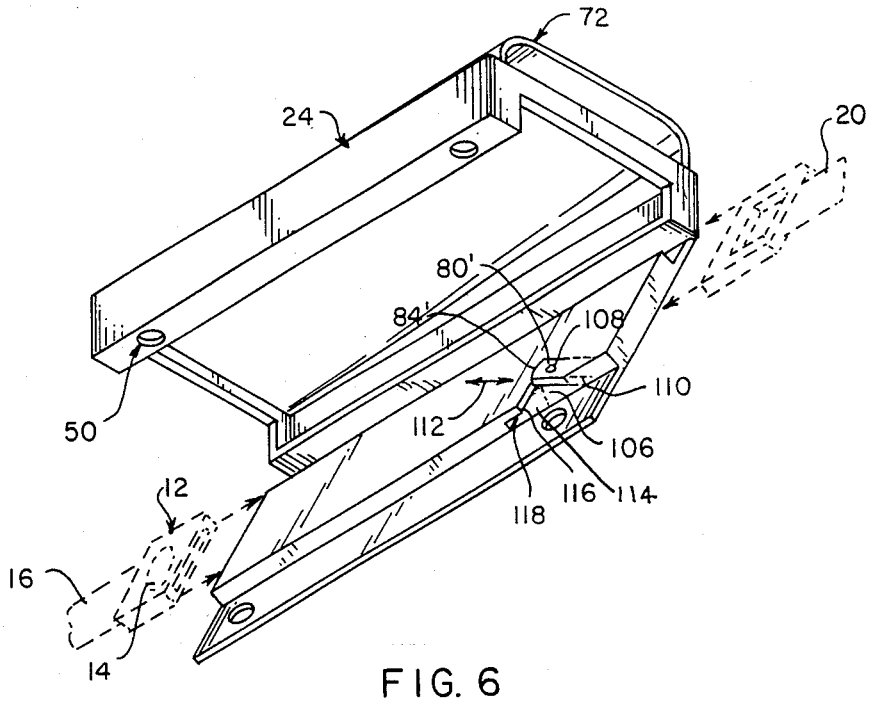
FIG. 6 is a perspective view of the child proofing cover shown in FIG. 4 to better show the operation of the button means and the buckle assembly separation preventing means.

Still another embodiment of the separation preventing means is shown in FIGS. 4–6 and includes a button means 90 for moving the tab element into the recess. The button means includes a button 92 slidably mounted in a recess defined in the housing to move into the housing when the button is depressed. The button includes a projection 94 on the lower surface thereof, and a projection 96 on one side surface thereof. The button 92 is biased outwardly of the housing by a spring 98 which abuts a surface in the housing cover and the bottom of the button. The spring 98 is adapted to maintain a biasing force on the button even if it is slightly twisted as will be evident from the ensuing discussion. Spring slots on the button can be used for this purpose.

As shown in FIG. 5, the housing includes a guide slot 100 defined in a position to receive the projection 96 of the button 92. The guide slot 100 includes a first channel 102 extending downwardly and a second channel 104 extending horizontally of the housing. The direction of extent of the second channel 104 depends on the location of the projection 94 with respect to the longitudinal centerline of the button.

The button is forced into the housing against the bias of the spring 98, and will move downward under the guidance of the slot channel 102. The button will then be twisted about its longitudinal axis (with the projection 94 extending longitudinally of the button) and the projection 96 will move under the guidance of the slot 104. The twisting can be accomplished by frictional contact between an adult's finger and the button. The downward and twisting movement of the button will force the projection 94 downward and forward for a purpose to be later described.

A tab 80' is located in the pallet 44 as above described to be biased into the FIG. 6 buckle blocking orientation by a spring 106. The tab 80' includes a recess 108 which is located to receive the projection 94 when the button has moved inwardly of the housing to the downward limit of the slot 102.

The tab 80' is movably mounted in a slot 110 that extends at an angle to the pallet top surface as shown in FIG. 6. The tab 80' thus is able to move up and down via the slot 110 as indicated in FIG. 6 by double headed arrow 112.

The recess 114 in the pallet 44 includes a ledge 116 which defines a cavity 118 therebeneath into which the leading edge 84' of tab 80' can fit to be held in the recess against the bias of the spring 106.

The tab 80' is moved to the cavity located position when the button 92 is twisted after it has been moved downwardly to the limit of slot 102 so the projection 94 has engaged the recess 108. When the button is forced to the bottom of the slot 102, it forces the tab 80' down into the recess to be co-planar with the top of the pallet 44. However, the spring bias of the spring 106 will tend to move the tab 80' back into the FIG. 6 orientation once the button is released.

However, when the button 92 is twisted, the tab 80' will be pushed into the cavity 118 beneath the ledge 116 to be held in the stowed condition out of the way. The tab 80' thus is moved out of the way by the button 92.

The tab 80' can then be released from the stowed condition to the FIG. 6 blocking position by twisting the button after the buckle elements have been coupled together. The twisting direction is the opposite to that just described, and the springs 98 and 106 will move the associated elements into the FIG. 6 tab buckle blocking orientation.

Again, as before, a plurality of separate operations are required to release the buckle elements so that a young child will not be able to perform all of such operations and thereby defeat the child-proof cover.

The cover 10 can be manufactured by injection molding techniques and thus is quite easily manufactured. The cover can be manufactured in a plurality of colors and can be sold as an add-on auto stores because it is so easily placed on the seat belts.

Yet another embodiment of the device is shown in FIGS. 7–11 and attention is now adverted thereto. The FIGS. 7–11 embodiment is designed so that the distance between the entrenceway to the hood defined finger access channel and the release control 14 of a seat belt buckle assembly can be adjusted to fit the exact length desired for the particular adult.

Figure 7:
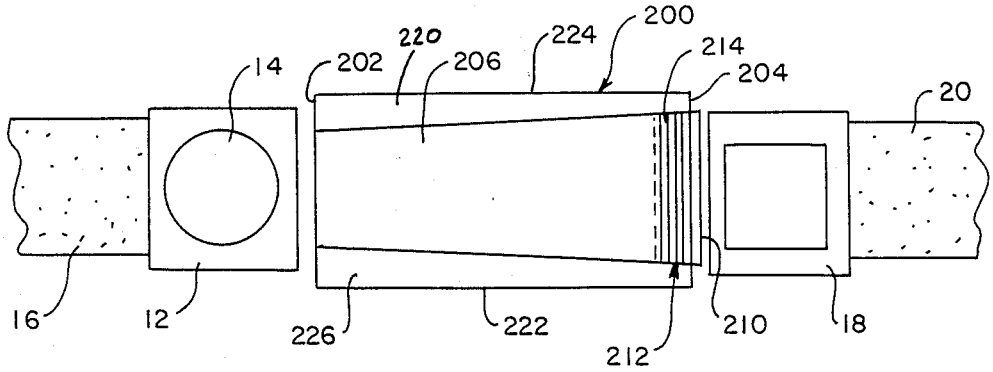
FIG. 7 is a top plan view of another embodiment of the child proofing cover of the present invention.
Figure 8:
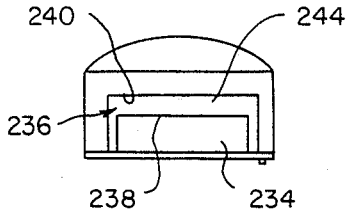
FIG. 8 is an end view of the FIG. 7 embodiment of the child proofing cover of the present invention.
Figure 9:
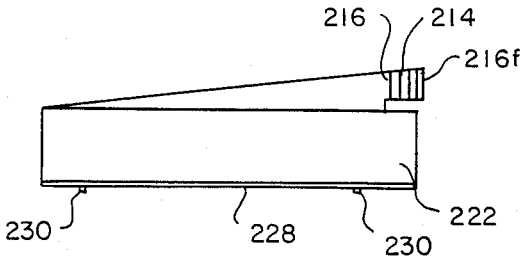
FIG. 9 is a side elevational view of the FIG. 7 embodiment of the child proofing cover of the present invention.
Figure 10:
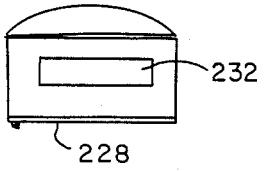
FIG. 10 is an end elevational view of the other end of the FIG. 7 embodiment of the child proofing cover.
Figure 11:
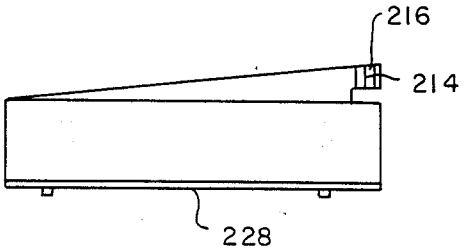
FIG. 11 is a side elevational view of the FIG. 7 embodiment with the finger access channel shortened from the length shown therefor in FIG. 9.

Thus, as shown in FIGS. 7–11, the cover 200 includes first end 202 located to be adjacent to the first buckle element 12 and a second end 204 located to be adjacent to the second buckle element 18. The cover 200 includes a finger access channel defining hood element 206 that extends from adjacent to end 204 to adjacent to end 202. However, as seen in FIG. 7, the hood element 206 has a forward end 210 that is located slightly forward of the end 204. As above discussed, the hood element defines a distance D to a location for operation of the release control 14 of the seat buckle assembly.

This distance D can be set at the factory when the cover is manufactured and can be set to accommodate most adult finger lengths. However, in some instances, this pre-set distance D may be too long for the adult who is actually using the cover. Accordingly, cover 200 includes a distance adjusting means 212 on the hood whereby an adult may shorten the pre-set distance D to his particular needs.

The distance adjusting means 212 can include may different elements, but the preferred embodiment of this means 211 is shown as including a plurality of score lines, such as score line 214, defined in the hood element 206 at locations thereon that are spaced apart along the longitudinal axis of the hood element to define a plurality of sections, such as section 216.

To shorten the hood element distance D, one need only tear one or more sections of the hood element off at a selected one of the score lines. This is illustrated by comparing FIGS. 9 and 11, wherein forwardmost section **216*f* has been removed from the FIG. 9 cover to define the FIG. 11** cover which has a distance D' that is shorter than the pre-set distance D.

The score lines can be designed to permit the removal of the sections 216 by use of a knife, or by including pull-tabs in the manner of lock-rings associated with liquid containers, such as milk bottles or the like.

The cover 200 also includes a monolithic body having sides 222 and 224 connected to a top 226 with a bottom 228 connected to the side 224 by a living hinge. Fasteners 230 can be inserted through mating holes in the bottom and the side 222 to attach the bottom to the side 222. The end 204 is unitary and includes a slot 232 through which the seat belt 20 extends when the buckle assembly is contained in the cover 200.

The end 202 includes a flap 234 attached to the bottom 228 and an opening defining bridge 236 defined by the top 226 and the sides 222 and 224. The flap is sized so top edge 238 thereof is spaced from edge 240 of the bridge to define a slot 244 through which belt 16 fits when the buckle assembly is contained in the cover 200.

It is to be understood that while certain forms of the present invention have been illustrated and described herein, it is not to be limited to the specific forms or arrangement of parts described and shown.

I claim:

1. A child proof cover for preventing a child from releasing a seat buckle assembly, which includes a first buckle element having a release control and which is operatively attached to a first seat belt and a second buckle element which is operatively attached to a second seat belt and which is adapted to be releasably coupled to the first buckle element to securely hold a child in place in a motor vehicle seat, the cover comprising:

a housing having a top and a bottom which co-operate to define a seat belt buckle assembly accommodating chamber within said housing, said housing including a first slot for accommodating the first seat belt and a second slot for accommodating the second seat belt when the buckle assembly is located inside said chamber;

said housing being sized and configured to completely encase the seat belt buckle assembly and including a finger access channel defining means on said top, said channel defining means being sized to define an access channel that extends for at least two and one-half inches before access to said buckle release control is provided via said channel to provide access to the buckle assembly release control from outside of said chamber to define a channel that is too long for a young child to insert his fingers far enough into said channel to operate the buckle release control yet short enough for an adult to insert his finger into said channel far enough to operate said buckle release control;

a buckle separation preventing means on said housing which includes a tab and a biasing means urging said buckle separation preventing means into a buckle separation preventing position and a button means for moving said buckle separation preventing means out of said buckle separation preventing position.

2. The child proof cover defined in claim 1 wherein said button means is located to be accessible from outside of said housing.

3. The child proof cover defined in claim 2 wherein said button means includes a projection and said tab includes a projection receiving opening.

4. The child proof cover defined in claim 3 wherein said button means further includes a spring.

5. The child proof cover defined in claim 1 wherein said tab further includes means for receiving an adult's fingernail so that said tab can be moved.

6. The child proof cover defined in claim 1 further including a length adjusting means on said finger access channel defining means for adjusting the length of said access channel.

7. The child proof cover defined in claim 6 wherein said length adjusting means includes a score line defined on said finger access channel defining means.

* * * * *